US007886936B2

(12) United States Patent
Helline

(10) Patent No.: US 7,886,936 B2
(45) Date of Patent: Feb. 15, 2011

(54) COOLER WITH INTEGRAL WATER STORAGE

(76) Inventor: Steven M. Helline, 5648 Vantage Hill Ave., NW., Massillon, OH (US) 44646

( * ) Notice: Subject to any disclaimer, the term of this patent is extended or adjusted under 35 U.S.C. 154(b) by 1280 days.

(21) Appl. No.: 11/338,499

(22) Filed: Jan. 24, 2006

(65) Prior Publication Data

US 2006/0163263 A1 Jul. 27, 2006

Related U.S. Application Data

(60) Provisional application No. 60/647,265, filed on Jan. 26, 2005.

(51) Int. Cl.
*B67D 7/06* (2010.01)
*A47J 39/00* (2006.01)
*A47F 1/00* (2006.01)

(52) U.S. Cl. ..... 222/185.1; 222/192; 222/146.6; 220/592.18; 220/592.03; 221/96; 4/625; 4/628

(58) Field of Classification Search ..... 222/143, 222/185.1, 192, 146.6, 146.1, 129, 183, 131, 222/130, 181.2, 181.3; 220/592.16, 592.22, 220/23.87, 592.18, 592.03; 62/457.7, 389; 4/628, 625; 221/97, 96

See application file for complete search history.

(56) References Cited

U.S. PATENT DOCUMENTS 2,338,455 A * 1/1944 Petri ..... 220/592.16
2,434,374 A * 1/1948 Tull ..... 62/188
2,570,283 A * 10/1951 Stevens ..... 222/132
2,716,508 A * 8/1955 Booth ..... 222/131
2,732,977 A * 1/1956 Charpiat ..... 222/131
3,395,550 A * 8/1968 Dungan ..... 62/400
3,572,054 A * 3/1971 Curcio ..... 62/390
3,613,872 A * 10/1971 Donnelly ..... 206/545
4,024,731 A 5/1977 Branscum
4,162,029 A 7/1979 Gottsegen et al.
4,195,757 A * 4/1980 Jefferson ..... 224/414
4,913,318 A * 4/1990 Forrester ..... 222/129
4,925,066 A * 5/1990 Rosenbaum ..... 222/129
5,080,261 A * 1/1992 Green ..... 222/129.1
5,329,787 A * 7/1994 Friday ..... 62/389
5,439,104 A * 8/1995 Wolska-Klis ..... 206/233
5,577,639 A * 11/1996 White ..... 222/192
5,690,255 A * 11/1997 White ..... 222/135
6,799,700 B2 * 10/2004 Durant et al. ..... 222/129
7,025,924 B2 * 4/2006 Lowance ..... 264/538
2003/0160066 A1 * 8/2003 Houvras ..... 222/181.3

* cited by examiner

*Primary Examiner*—Kenneth Bomberg
*Assistant Examiner*—Stephanie E Williams
(74) *Attorney, Agent, or Firm*—Sand & Sebolt

(57) ABSTRACT

A insulated cooler includes a thermally insulated storage compartment and a water storage chamber mounted thereon and preferably formed integrally therewith. A water spout communicates with the water storage chamber to permit water to flow from the storage chamber for washing hands and the like when in areas without running water. A soap dispenser is mounted on the cooler to facilitate the washing process. An external carrier may also be mounted on the cooler for carrying various items which do not need to be stored within the insulated storage compartment.

19 Claims, 5 Drawing Sheets

COOLER WITH INTEGRAL WATER STORAGE

CROSS REFERENCE TO RELATED APPLICATIONS

This application claims priority from U.S. provisional application Ser. No. 60/647,265 filed Jan. 26, 2005; the disclosure of which is incorporated herein by reference.

BACKGROUND OF THE INVENTION

1. Technical Field

The invention relates generally to insulated coolers. More particularly, the invention relates to an insulated cooler having integral water storage. Specifically, the invention relates to a portable insulated cooler having integral water storage and a soap dispenser to facilitate the washing of hands, dishes and the like.

2. Background Information

Insulated coolers are well-known and typically are in the form of a box-like structure which is insulated and has an interior chamber in which food or drinks may be stored to maintain their temperature, most commonly to maintain them at a relatively cool temperature. Such coolers come in a wide variety of sizes, many of which are small enough to be portable. These portable coolers are often used by people who work in areas where no running water is available. This category workers would include those working in the fields of excavation, construction, masonry, landscaping, farming, plumbing, the laying of steel and the like. In addition, hikers and campers are often in locations without running water. As a result, such people often eat their lunches or other meals without washing their hands. The present invention addresses this and other problems.

BRIEF SUMMARY OF THE INVENTION

The present invention provides a cooler comprising a container defining a thermally insulated storage compartment; a water storage chamber mounted on the container which is distinct from the storage compartment; and a selectively openable and closeable spout mounted on the container wherein the spout is in fluid communication with the water storage chamber and adapted to allow water to flow from the compartment to the spout.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
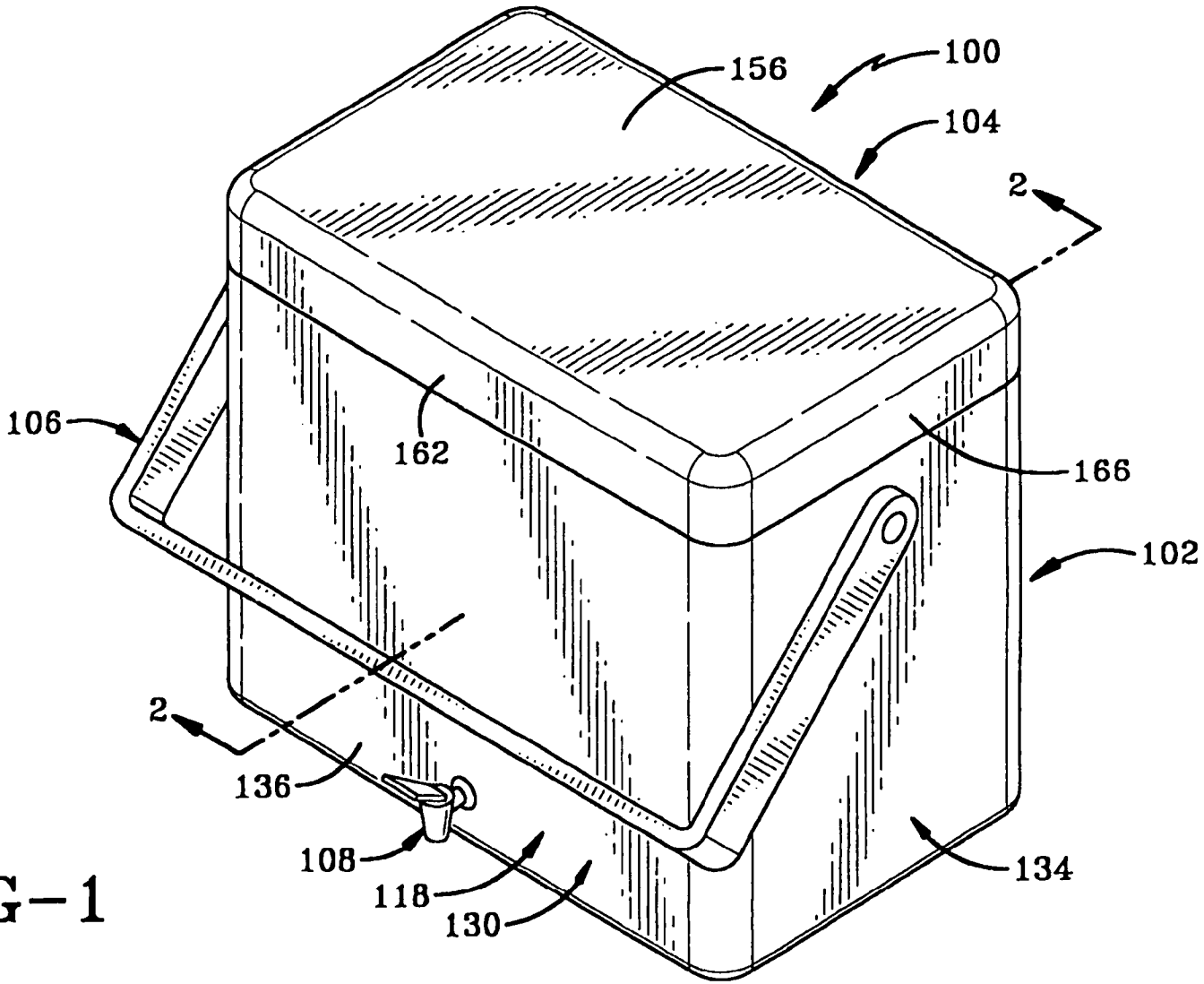
FIG. 1 is a perspective view of a first embodiment of the cooler of the present invention.
Figure 2:
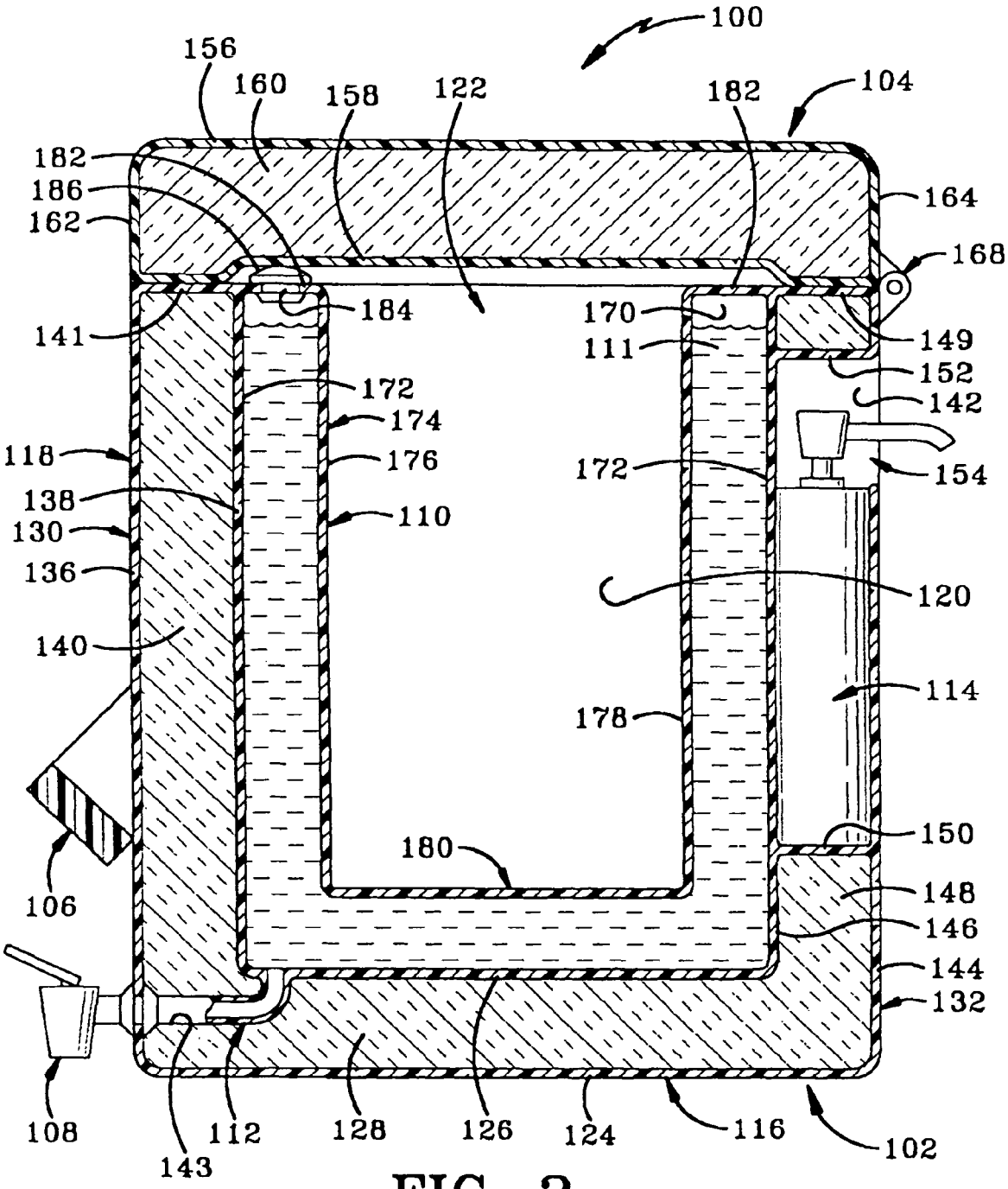
FIG. 2 is a sectional view taken on line 2-2 of FIG. 1.
Figure 3:
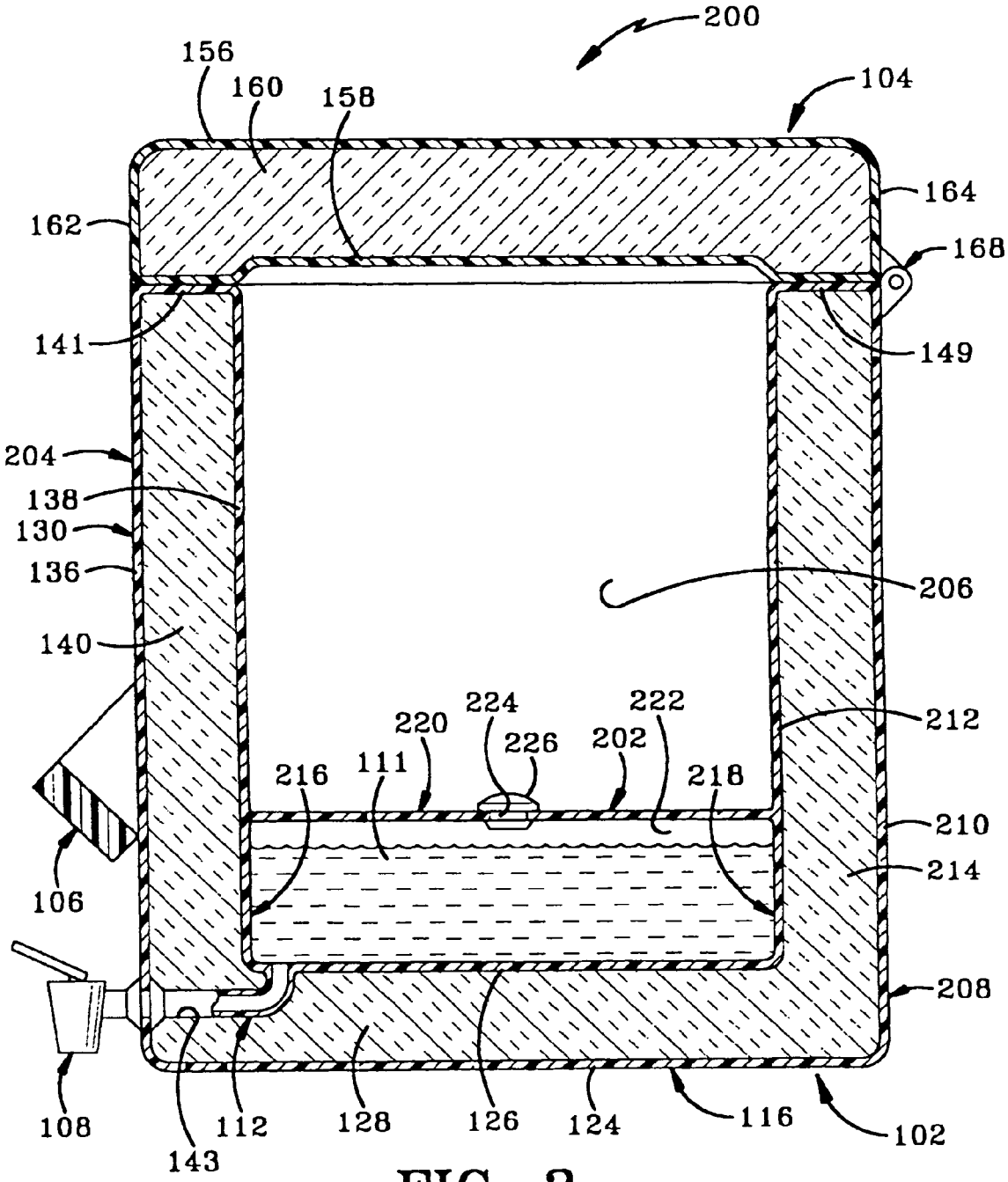
FIG. 3 is a sectional view similar to that of FIG. 2 of a second embodiment of the present invention.
Figure 4:
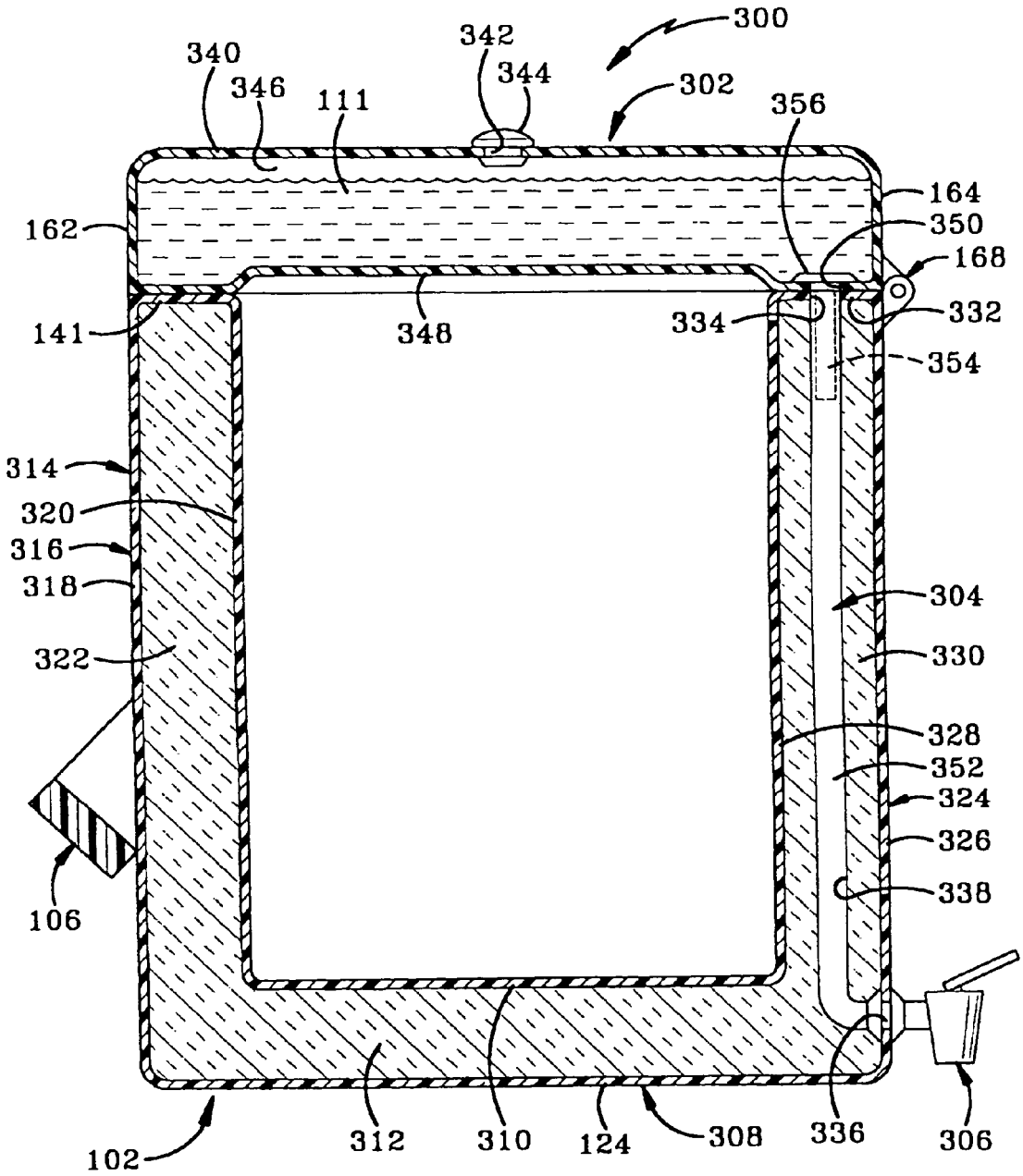
FIG. 4 is a sectional view similar to FIGS. 2 and 3 of a third embodiment of the present invention.
Figure 5:
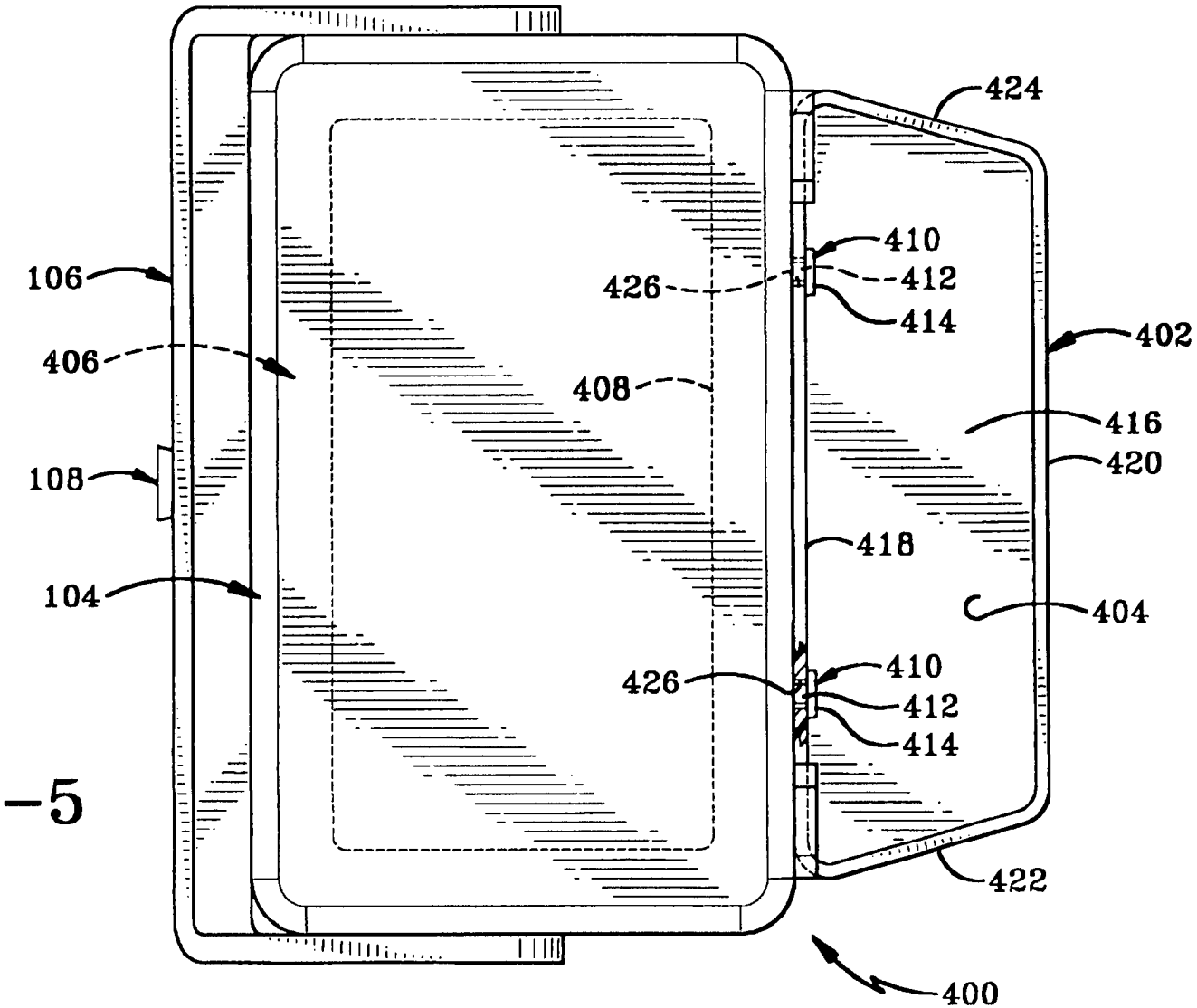
FIG. 5 is a top plan view of the fourth embodiment of the present invention.

A first embodiment of the cooler of the present invention is indicated generally at 100 in FIGS. 1-2; a second embodiment is indicated generally at 200 in FIG. 3; a third embodiment is indicated generally at 300 in FIG. 4; and a fourth embodiment is indicated generally at 400 in FIG. 5.

With reference to FIG. 1, cooler 100 is generally in the form of a box-like container and includes a base 102 and a lid 104 which is selectively openable and closable. Handle 106 is pivotally mounted on opposed sides of base 102 for carrying cooler 100. A water spout or valve 108 is mounted on base 102 for selectively controlling the flow of water therefrom.

In accordance with a feature of the invention and with reference to FIG. 2, cooler 100 further includes a water storage chamber 110 configured to contain water 111 and a conduit 112 extending between storage chamber 110 and water valve 108, thereby defining a passage between chamber 110 and valve 108. Cooler 100 further includes a soap dispenser 114 mounted on base 102.

With continued reference to FIG. 2, base 102 includes a base wall 116 and a side wall 118 extending upwardly therefrom around a main storage compartment or interior chamber 120 having an entrance opening 122 which opens upwardly. As is well-known in the art, main storage compartments analogous to interior chamber 120 are typically used for the storage of food and drinks although other items may be stored there as well.

With continued reference to FIG. 2, base wall 116 includes a substantially flat and a substantially horizontal wall or outer layer 124 and a substantially flat and substantially horizontal inner layer 126 with a middle layer 128 disposed between outer layer 124 and inner layer 126 in the form of an insulated material. Middle layer 128 is substantially thicker than outer and inner layers 124 and 126, each of which has a thickness which is substantially the same as the other.

Side wall 118 (FIG. 2) includes a front wall 130, a back wall 132 and a pair of end walls 134 (only one shown in FIG. 1) which extend between and are connected to each of front wall 130 and back wall 132. Each of front wall 130, back wall 132 and end walls 134 are layered in a similar manner as described with regard to base wall 116. Thus, front wall 130 has an outer wall or layer 136 which is substantially flat and vertically oriented, an inner layer 138 which is substantially flat and vertical and a middle layer 140 disposed between outer and inner layers 136 and 138 in the form of an insulative material. Front wall 130 includes a top wall 141 at the upper end thereof which extends horizontally between and is connected to outer layer 136 and inner layer 138. Each end wall 134 is layered in the same manner as front wall 130. Conduit 112 is disposed in a passage 143 extending from storage chamber 110 adjacent the intersection of front wall 130 and base wall 116. More particularly, conduit 112 extends downwardly from inner layer 126 of base wall 116 in to middle layer 128 thereof and then forward through outer layer 136 of front wall 130 to connect to valve 108.

Back wall 132 (FIG. 2) is also layered in this same manner. However, back wall 132 defines a cavity 142 in which soap dispenser 114 is disposed. Cavity 142 thus displaces some portion of the insulated material of back wall 132. More particularly, back wall 132 includes an outer layer 144 which is substantially flat and substantially vertical, an inner layer 146 which is substantially flat and substantially vertical and a middle layer 148 disposed between outer and inner layers 144 and 146 in the form of an insulative material. Back wall 132 includes a top wall 149 which extends horizontally between and is connected to outer layer 144 and inner layer 146. A substantially horizontal lower shelf 150 extends between and is connected to inner layer 146 and outer layer 144 of back wall 132 and bounds a lower end of cavity 142. A portion of inner layer 146 extends upwardly from lower shelf 150 and bounds a forward side of cavity 142. A substantially horizontal upper shelf 152 is disposed upwardly of lower shelf 150 and bounds an upper end of cavity 142. Upper shelf 152 extends between outer and inner layers 144 and 146 of back wall 132. A portion of outer layer 144 extends upwardly from lower shelf 150 part way to upper shelf 152 and thus terminates in a point spaced downwardly from upper shelf 152, thereby defining an entrance opening 154 to cavity 142, said entrance opening 154 opening rearwardly. The portion of outer layer 144 extending upwardly from lower shelf 152 serves as a retaining wall for retaining soap dispenser 114.

Lid 104 (FIGS. 1-2) is substantially in the form of a rectangular slab and includes a substantially flat upper or outer layer 156, a substantially flat lower or inner layer 158 and a middle layer 160 disposed between outer and inner layers 156 and 158 in the form of an insulative material. A front wall 162 extends between and is connected to outer layer 156 and inner layer 158 and a rear wall 164 similarly extends between and is connected to outer layer 156 and inner layer 158. Lid 104 further includes a pair of end walls 166 (only one shown in FIG. 1) each extending between outer layer 156 and inner layer 158 as well as between front wall 162 and rear wall 164. Lid 104 is moveable between open and closed positions via pivotal movement about a hinge 168 mounted on rear wall 164 of lid 104 and outer layer 144 of back wall 132.

In accordance with a feature of the invention and with continued reference to FIG. 2, water storage chamber 110 is further detailed. Chamber 110 is disposed upwardly of base wall 116 and inwardly of side wall 118 and in cross-section is U-shaped. More particularly, water storage chamber 110 defines an interior chamber 170 in which water 111 may be stored. Inner layer 126 of base wall 116 serves as an outer bottom wall of storage chamber 110 which thereby bounds a lower end of interior chamber 170. Chamber 1-10 has an outer periphery 172 defined by inner layer 138 of front wall 130 and inner layer 146 of back wall 132 along with analogous inner layers (not shown) of end walls 134. Chamber 110 further includes an interior side wall 174 which is substantially vertical and surrounds interior chamber 120 of cooler 100, defining the sides of said chamber 120. Side wall 174 includes a front wall 176, a rear wall 178 and a pair of end walls (not shown) analogous thereto each extending between and connected to front wall 176 and rear wall 178 and spaced inwardly of a respective end wall 134.

Chamber 110 (FIG. 2) further includes an inner bottom wall 180 which is substantially horizontal and spaced upwardly of inner layer 126 of base wall 116. Side wall 174 extends upwardly from and is connected to inner bottom wall 180 whereby bottom wall 180 and sidewall 174 define chamber 120 therebetween. Storage chamber 110 further includes an upperwall 182 which extends between and is connected to side wall 174 and inner layer 138 of front wall 130 as well as between side wall 174 and inner layer 146 of back wall 132. Upper wall 182 is substantially horizontal and extends inwardly from each of top wall 141 and top wall 149 and is on the same level as said top walls 141 and 149. Adjacent front wall 130, upper wall 182 defines a water fill hole 184 in which a cap or plug 186 is removably disposed to selectively allow water to be poured into interior chamber 170 or emptied therefrom.

With reference to FIG. 3, cooler 200 is now described. Cooler 200 is similar to cooler 100 except cooler 200 is free of a soap dispenser and a cavity for holding such a dispenser and includes a water storage chamber 202 having a different configuration than that of chamber 110 of cooler 100. Thus, cooler 200 has a side wall 204 analogous to side wall 118 of cooler 100 wherein side wall 204 extends continuously from top to bottom all the way around an interior chamber 206 of cooler 200. Unlike cooler 100, side wall 204 includes a back wall 208 free of a cavity such as cavity 142 of back wall 132 of cooler 100. Back wall 208 includes a substantially flat outer layer 210, an inner layer 212 and a middle layer 214 in the form of an insulative material. Outer layer 210 extends continuously from outer layer 124 of base wall 116 to top wall 149. Back wall 208 is therefore also free of shelves analogous to shelf 150 and 152 of cooler 100.

With continued reference to FIG. 3, inner layer 126 of base wall 116 serves as a bottom wall of storage chamber 202. A lower portion 216 of inner layer 138 of front wall 130 serves as a front wall of storage chamber 202 and a lower portion 218 of inner layer 212 of back wall 208 serves as a rear wall of storage chamber 202. Storage chamber 202 further includes an upper wall 220 which is substantially flat and horizontal and spaced upwardly of inner layer 126 of base wall 116. Upper wall 220 extends between and is connected to inner layer 138 of front wall 130 and inner layer 212 of back wall 208. Upperwall 220 similarly extends between and is connected to analogous inner walls (not shown) of respective end walls 134 (FIG. 1). Storage chamber 202 defines an interior chamber 222 for containing water 111. More particularly, upper wall 220, inner layer 126 and lower portions 216 and 218 define interior chamber therebetween. Upperwall 220 defines a water fill hole 224 in which is removably disposed a cap or plug 226. Upper wall 220 of storage chamber 202 defines a lower end of interior chamber 206 and is disposed distal lid 104 and adjacent base wall 116.

With reference to FIG. 4, cooler 300 is described. Cooler 300 is similar to cooler 200 except that the water storage chamber is located in a lid 302 which is in communication via a rearwardly disposed conduit 304 (described further below) with a rearwardly disposed water valve or spout 306. Thus, a water storage chamber is not disposed within the main storage compartment used for the storage of foods, drinks and the like. Cooler 300 includes a base wall 308 analogous to base wall 116 of coolers 100 and 200 and includes outer layer 124. However, base wall 308 is free of holes, a pathway or conduits which pass through an inner layer 310 thereof or through a forward portion of an insulative middle layer 312 thereof. Conduit 304 does, however, pass through or adjacent a rearward portion of middle layer 312. Cooler 300 includes a side wall 314 which extends upwardly from base wall 308 in a similar fashion as those of coolers 100 and 200. Side wall 314 includes a front wall 316 having an outer layer 318, and inner layer 320 and a middle layer 322 disposed therebetween in the form of an insulative material. Other than location, front wall 316 has substantially the same configuration as rear wall 208 of cooler 200 and is not described in further detail.

Side wall 314 further includes a back wall 324 having an outer layer 326, an inner layer 328 and a middle layer 330 disposed therebetween in the form of an insulative material. Back wall 324 further includes an upperwall 332 defining a hole 334 therein. Adjacent outer layer 124 of base wall 308, outer layer 326 of back wall 324 defines a hole 336 adjacent which spout 306 is mounted and through which a portion of spout 306 or conduit 304 passes. Middle layer 330 of back wall 324 defines an elongated passage 338 extending from upper wall 332 downwardly toward outer layer 124 of base wall 308 whereby passage 338 is in communication with holes 334 and 336. Conduit 334 is disposed primarily within passage 338 and extends upwardly through hole 334 of upper wall 332.

With continued reference to FIG. 4, lid 302 includes an outer layer or upper wall 340 similar to outer layer 156 of lid 104 except that upper wall 340 defines a water fill hole 342 in which is removably disposed a cap or plug 344. Lid 302 serves as the water storage chamber of cooler 300 and defines an interior chamber 346 in which water 111 may be stored. Lid 302 further includes a lower wall 348 which is analogous to inner layer 158 of lid 104 except that it defines a hole 350 adjacent rear wall 164 through which conduit 304 passes whereby conduit 304 defines a passage in communication with interior chamber 346 and water valve or spout 306.

Conduit 304 is now further described. Conduit 304 includes a lower portion 352 which extends from upper wall 332 within hole 334 to adjacent hole 336 in outer layer 326 of back wall 324. Conduit 304 further includes an upper portion 354 which is flexible and slidably inserted within lower portion 352 thereby allowing a continuous passage to be maintained when lid 302 moves between open and closed positions. Upper portion 354 is configured to slide easily within lower portion 352 while also maintaining a seal with lower portion 352 to prevent water leakage. Upper portion 354 is mounted on lower wall 348 of lid 302 via a mounting flange 356. Thus, upper portion 354 extends from flange 356 through hole 350 and into the passage defined by lower portion 352. Conduit 304 may alternately be formed of a single tube which is flexible and has an upper portion which allows for the opening and closing of lid 302, such as an accordion-like tubing section.

Cooler 400 is similar to coolers 100, 200 and 300 with the major exception being that cooler 400 includes an external carrier 402 defining an interior chamber 404 for containing various small items which a user of cooler 400 may desire to carry along with the items stored within the storage compartment thereof. Carrier 402 is thus configured to contain tools, eating utensils, napkins, first aid kit, tobacco, soap, cell phone, keys and so forth. Cooler 400 includes a base 406 which defines the storage compartment and water storage chamber similar to one of the previous embodiments. Base 406 includes an insulated back wall 408. A mounting mechanism for mounting carrier 402 on back wall 408 includes a pair of posts 410 having respective rods 412 mounted on wall 408 and enlarged heads 414 spaced outwardly from wall 408.

Carrier 402 includes a bottom wall 416, spaced side walls 418 and 420 and spaced end walls 422 and 424 extending upwardly from bottom wall 416 to define therewithin interior chamber 404. Side wall 418 defines key hole shaped openings 426 for respectively receiving enlarged heads 414 in an enlarged portion thereof so that carrier 402 may be slid downwardly with rods 412 disposed within a narrower portion of openings 426 to mount carrier 402 on back wall 408. Carrier 402 is removably mounted on back wall 408. It will be evident to one skilled in the art that a variety of mounting mechanisms may be used to either permanently affix or removably mount an external carrier on a cooler such as cooler 400. The external carrier may be formed integrally with the cooler.

It is noted that the walls which bound the water storage chambers of the various embodiments may be formed of materials which allow for the expansion and contraction of water during the freezing and thawing process thereof so that the water storage chambers may be used to help keep the contents of the storage compartments cool via the use of ice within the water storage chambers. In addition, chilled water may be used in the water storage chambers to facilitate cooling of the storage compartments of the various coolers.

Thus, coolers 100, 200 and 300 provide an insulated cooler having a water storage chamber in communication with a spout which may be opened and closed to allow the water to flow out, for the washing of hands and the like. Cooler 100 further provides a soap dispenser to facilitate washing. These coolers provide a simple system for allowing a person to carry a lunch or other food to a place without running water and allow them to conveniently wash their hands or use the water for other purposes. In addition, cooler 400 provides an external carrier for carrying various items which do not need to be insulated, thus adding to the convenience of the possible configurations of the coolers described herein.

It will be appreciated by one skilled in the art that a variety of changes may be made to the coolers shown and described herein without departing from the spirit of the invention. For example, the water storage chambers may come in a wide variety of configurations. Preferably, the water storage chambers are configured to provide a balanced cooler so that when the cooler is picked up by the handle, it does not tend to tilt substantially in one direction or another. In addition, the water storage chamber may be formed outwardly of the insulated walls of the cooler. However, it is preferred to have the water storage chamber disposed either inwardly of the insulated walls or in the lid of the cooler in order to protect the water storage chamber from being punctured during handling thereof. In addition, a lid may be formed which includes both a water storage chamber and an insulative material. Similarly, a water storage chamber or portion thereof may be disposed between two layers of insulation within the bottom wall, sidewall or lid. In addition, the spout and conduit may extend from the water storage chamber through one of the end walls. Likewise, a soap dispenser may be formed in the front wall or in the end walls of the cooler. Other variations will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A cooler comprising:

a container defining a thermally insulated wall surrounding a storage compartment;

a water storage chamber of the container which is distinct from the storage compartment;

a selectively openable and closeable spout mounted on the container, the spout in fluid communication with the water storage chamber and adapted to allow water to flow from the water storage chamber; and a soap dispenser mounted on the container to facilitate washing hands;

an exterior of the thermally insulated wall defining a cavity in which the soap dispenser is disposed.

2. The cooler of claim 1 wherein the insulated wall comprises an inner layer, an outer layer and a middle layer of insulative material between the inner and outer layers; and the soap dispenser is between the inner and outer layers.

3. The cooler of claim 1 wherein the insulated wall bounds the water storage chamber.

4. The cooler of claim 2 wherein a lower portion of the middle layer of insulative material is below the dispenser.

5. The cooler of claim 2 wherein an upper portion of the middle layer of insulative material is above the dispenser.

6. The cooler of claim 2 wherein the insulated wall comprises a lower shelf which extends between and is connected to the inner layer and the outer layer, and which bounds a lower end of the cavity.

7. The cooler of claim 2 wherein the inner layer of the insulated wall bounds the water storage chamber.

8. The cooler of claim 4 wherein an upper portion of the middle layer of insulative material is above the dispenser.

9. The cooler of claim 4 wherein the insulated wall comprises a lower shelf which extends between and is connected to the inner layer and the outer layer, which bounds a lower end of the cavity and which is above the lower portion of the middle layer.

10. The cooler of claim 8 wherein the insulated wall comprises a lower shelf which extends between and is connected to the inner layer and the outer layer, which bounds a lower end of the cavity and which is above the lower portion of the middle layer.

11. The cooler of claim 10 wherein the insulated wall comprises an upper shelf which extends between and is connected to the inner layer and the outer layer, which bounds an upper end of the cavity and which is below the upper portion of the middle layer.

12. The cooler of claim 10 wherein the inner layer of the insulated wall bounds the water storage chamber.

13. The cooler of claim 11 wherein the inner layer of the insulated wall bounds the water storage chamber.

14. The cooler of claim 11 wherein the insulated wall comprises a top wall which extends between and is connected to the inner and the outer layer above the upper portion of the middle layer.

15. The cooler of claim 11 wherein a portion of the outer layer extends upwardly from the lower shelf part way to the upper shelf and terminates at a point spaced downwardly from the upper shelf to define an entrance opening to the cavity between the point and the upper shelf; and the soap dispenser is between the inner layer and the portion of the outer layer which extends upwardly from the lower shelf.

16. The cooler of claim 5 wherein the insulated wall comprises an upper shelf which extends between and is connected to the inner layer and the outer layer, which bounds an upper end of the cavity and which is below the upper portion of the middle layer.

17. The cooler of claim 16 wherein the insulated wall comprises a top wall which extends between and is connected to the inner and the outer layer above the upper portion of the middle layer.

18. The cooler of claim 6 wherein the insulated wall comprises an upper shelf which extends between and is connected to the inner layer and the outer layer, and which bounds an upper end of the cavity.

19. The cooler of claim 18 wherein a portion of the outer layer extends upwardly from the lower shelf part way to the upper shelf and terminates at a point spaced downwardly from the upper shelf to define an entrance opening to the cavity between the point and the upper shelf; and the soap dispenser is between the inner layer and the portion of the outer layer which extends upwardly from the lower shelf.

* * * * *